US008342102B2

(12) United States Patent
Tinsley et al.

(10) Patent No.: US 8,342,102 B2
(45) Date of Patent: Jan. 1, 2013

(54) DUAL PATH KILN IMPROVEMENT

(76) Inventors: Douglas M Tinsley, Hot Springs, AR (US); Terry R Freeman, Russellville, AR (US); William S Smoke, Homer, LA (US); Levi A Pollard, Appling, GA (US)

( * ) Notice: Subject to any disclaimer, the term of this patent is extended or adjusted under 35 U.S.C. 154(b) by 0 days.

(21) Appl. No.: 13/467,137

(22) Filed: May 9, 2012

(65) Prior Publication Data

US 2012/0227276 A1 Sep. 13, 2012

Related U.S. Application Data

(62) Division of application No. 12/554,165, filed on Sep. 4, 2009, now Pat. No. 8,201,501.

(51) Int. Cl.
*B61B 9/00* (2006.01)

(52) U.S. Cl. ..... 104/172.3; 34/201; 34/396

(58) Field of Classification Search ..... 34/201, 34/396; 104/172.3, 173.1
See application file for complete search history.

(56) References Cited

U.S. PATENT DOCUMENTS

| | | | |
|---|---|---|---|
| 997,092 | A | 7/1911 | Reyscher |
| 1,328,661 | A | 1/1920 | Fish |
| 1,366,225 | A | 1/1921 | Weiss |
| 1,413,018 | A | 4/1922 | Kakuji |
| 1,593,598 | A | 7/1926 | Redman |
| 1,953,193 | A | 4/1934 | Sampson |
| 2,060,111 | A | 11/1936 | Phillips |
| 2,185,760 | A | 1/1940 | Altenkirch |
| 2,202,143 | A | 5/1940 | Cobb |
| 2,237,255 | A | 4/1941 | Finnegan |
| 2,288,154 | A | 6/1942 | Cobb |
| 2,363,294 | A | 11/1944 | Carrier |
| 2,363,945 | A | 11/1944 | Carrier |
| 2,383,504 | A | 8/1945 | Luckhaupt |
| 2,397,993 | A | 4/1946 | Urquhart |
| 2,408,434 | A | 10/1946 | Mann |
| 2,425,660 | A | 8/1947 | Ware |
| 2,463,782 | A | 3/1949 | Leischner |
| 2,519,340 | A | 8/1950 | Bailey |
| 2,521,554 | A | 9/1950 | Ware |
| 2,527,782 | A | 10/1950 | Williams |
| 2,529,366 | A | 11/1950 | Bauer |
| 2,575,426 | A | 11/1951 | Parnell |
| 2,593,709 | A | 4/1952 | Ware |
| 2,603,004 | A | 7/1952 | Quimby |

(Continued)

FOREIGN PATENT DOCUMENTS

| | | | |
|---|---|---|---|
| CH | 677527 | A | 5/1991 |

(Continued)

*Primary Examiner* — Jason C Smith
(74) *Attorney, Agent, or Firm* — Jeffrey S. Melcher; Manelli Selter PLLC

(57) ABSTRACT

A dual path kiln is provided that includes a kiln having one or more chambers and at least two lumber charge paths adapted to convey lumber through the kiln in opposite directions by means of a track having two rails in which a pusher device pushes the lumber through the kiln and comprises a variable output electric motor to effect a high degree of accurate control of the movement speed of the pusher device and the lumber it's pushing and wherein the pusher device includes a faceplate having two side walls extending from said faceplate to engage the side of the lumber in order to greatly enhance stability of the lumber while it is being transported and minimize the risk of spillage.

13 Claims, 6 Drawing Sheets

U.S. PATENT DOCUMENTS

| | | | | | |
|---|---|---|---|---|---|
| 2,687,192 | A | | 8/1954 | Butterfield | |
| 2,706,344 | A | | 4/1955 | Vaughan | |
| 2,717,825 | A | | 9/1955 | Greenawalt | |
| 2,834,120 | A | | 5/1958 | Greenhood | |
| 2,860,070 | A | | 11/1958 | McDonald | |
| 2,892,261 | A | | 6/1959 | Hutchinson | |
| 2,956,933 | A | | 10/1960 | Jolin | |
| 2,992,152 | A | | 7/1961 | Chapman | |
| 3,002,877 | A | | 10/1961 | McDonald | |
| 3,061,878 | A | | 11/1962 | Chapman | |
| 3,090,130 | A | | 5/1963 | Smith | |
| 3,196,554 | A | | 7/1965 | Smith | |
| 3,199,213 | A | | 8/1965 | Milligan | |
| 3,233,097 | A | | 2/1966 | Watkins | |
| 3,234,659 | A | | 2/1966 | Smith | |
| 3,262,216 | A | | 7/1966 | Dugger | |
| 3,269,136 | A | | 8/1966 | Umano | |
| 3,307,529 | A | | 3/1967 | Fannon | |
| 3,324,939 | A | | 6/1967 | Laing | |
| 3,334,595 | A | * | 8/1967 | Natof | 104/172.3 |
| 3,337,967 | A | | 8/1967 | Smith | |
| 3,449,116 | A | | 6/1969 | Derham | |
| 3,470,623 | A | | 10/1969 | Hildebrand | |
| 3,529,358 | A | | 9/1970 | Robinson | |
| 3,545,094 | A | | 12/1970 | Barnes | |
| 3,571,943 | A | | 3/1971 | Sipple | |
| 3,574,949 | A | | 4/1971 | Farnsworth | |
| 3,589,313 | A | | 6/1971 | Smith | |
| 3,680,219 | A | | 8/1972 | Koch | |
| 3,714,716 | A | | 2/1973 | Dedrick | |
| 3,721,013 | A | | 3/1973 | Miller | |
| 3,741,890 | A | | 6/1973 | Smith | |
| 3,744,147 | A | | 7/1973 | Pless | |
| 3,757,428 | A | | 9/1973 | Runciman | |
| 3,782,000 | A | | 1/1974 | Pless | |
| 3,818,601 | A | | 6/1974 | Cooper | |
| 3,861,150 | A | | 1/1975 | Lear | |
| 3,902,253 | A | * | 9/1975 | Sabuzawa et al. | 34/256 |
| 3,913,351 | A | | 10/1975 | Edwards | |
| 3,933,128 | A | | 1/1976 | Cramer | |
| 3,939,573 | A | | 2/1976 | Berti | |
| 3,945,331 | A | | 3/1976 | Drake | |
| 3,967,466 | A | | 7/1976 | Edwards | |
| 3,986,268 | A | * | 10/1976 | Koppelman | 34/257 |
| 4,014,107 | A | * | 3/1977 | Bachrich | 34/191 |
| 4,017,980 | A | | 4/1977 | Kleinguenther | |
| 4,031,631 | A | | 6/1977 | Robinson | |
| 4,033,113 | A | | 7/1977 | Cramer | |
| 4,071,637 | A | | 1/1978 | Dittrich | |
| 4,106,215 | A | | 8/1978 | Rosen | |
| 4,111,744 | A | | 9/1978 | Reiniger | |
| 4,121,350 | A | | 10/1978 | Buchholz | |
| 4,122,356 | A | | 10/1978 | Decker | |
| 4,148,356 | A | | 4/1979 | Cramer | |
| 4,169,583 | A | | 10/1979 | Cramer | |
| 4,176,466 | A | | 12/1979 | Pagnozzi | |
| 4,182,048 | A | | 1/1980 | Wolfe | |
| 4,194,296 | A | | 3/1980 | Pagnozzi | |
| 4,196,526 | A | | 4/1980 | Berti | |
| 4,212,635 | A | | 7/1980 | North | |
| 4,213,947 | A | | 7/1980 | Fremont | |
| 4,228,783 | A | | 10/1980 | Kalenian | |
| 4,233,024 | A | | 11/1980 | Plass | |
| 4,261,110 | A | | 4/1981 | Northway | |
| 4,280,878 | A | | 7/1981 | Sprenger | |
| 4,298,560 | A | | 11/1981 | Plass | |
| 4,343,607 | A | | 8/1982 | Coleman | |
| 4,348,211 | A | | 9/1982 | Zimmerman | |
| 4,357,758 | A | | 11/1982 | Lampinen | |
| 4,378,640 | A | | 4/1983 | Buchholz | |
| 4,399,619 | A | | 8/1983 | Martin | |
| 4,403,948 | A | | 9/1983 | Waldmann | |
| 4,416,069 | A | | 11/1983 | Rosen | |
| 4,420,299 | A | | 12/1983 | De Mets | |
| 4,432,147 | A | | 2/1984 | Chen | |
| 4,445,559 | A | | 5/1984 | Coleman | |
| 4,445,910 | A | | 5/1984 | Zimmerman | |
| 4,455,837 | A | | 6/1984 | Firey | |
| 4,466,198 | A | | 8/1984 | Doll | |
| 4,467,532 | A | | 8/1984 | Drake | |
| 4,468,256 | A | | 8/1984 | Hinger | |
| 4,484,531 | A | | 11/1984 | Firey | |
| 4,490,926 | A | | 1/1985 | Stokes | |
| 4,495,165 | A | | 1/1985 | Gurza | |
| 4,497,637 | A | | 2/1985 | Purdy | |
| 4,501,205 | A | | 2/1985 | Funk | |
| 4,530,700 | A | | 7/1985 | Sawyer | |
| 4,545,360 | A | | 10/1985 | Smith | |
| 4,554,076 | A | | 11/1985 | Speaker | |
| 4,559,882 | A | | 12/1985 | Dobson | |
| 4,561,261 | A | | 12/1985 | Kornrumpf | |
| 4,564,368 | A | | 1/1986 | Sawyer | |
| 4,580,354 | A | | 4/1986 | Lindberg | |
| 4,620,373 | A | * | 11/1986 | Laskowski et al. | 34/406 |
| 4,621,503 | A | | 11/1986 | Woods | |
| 4,663,860 | A | | 5/1987 | Beall | |
| 4,675,029 | A | | 6/1987 | Norman | |
| 4,690,611 | A | * | 9/1987 | Nobuhara | 414/661 |
| 4,722,322 | A | | 2/1988 | Varney | |
| 4,771,708 | A | | 9/1988 | Douglass | |
| 4,781,778 | A | | 11/1988 | Olofsson | |
| 4,862,599 | A | | 9/1989 | Brunner | |
| 4,908,104 | A | | 3/1990 | Loomans | |
| 4,922,624 | A | | 5/1990 | Tharpe | |
| RE33,273 | E | | 7/1990 | Speaker | |
| 4,941,521 | A | | 7/1990 | Redekop | |
| 5,017,269 | A | | 5/1991 | Loomans | |
| 5,059,404 | A | | 10/1991 | Mansour | |
| 5,062,372 | A | | 11/1991 | Ritter | |
| 5,171,613 | A | | 12/1992 | Bok | |
| 5,188,740 | A | | 2/1993 | Khan | |
| 5,240,656 | A | | 8/1993 | Scheeres | |
| 5,243,963 | A | | 9/1993 | Riener | |
| 5,256,255 | A | | 10/1993 | Fagerlund | |
| 5,263,266 | A | | 11/1993 | Schmidt | |
| 5,269,076 | A | | 12/1993 | Breckenridge | |
| 5,271,340 | A | | 12/1993 | Whitney | |
| 5,279,712 | A | | 1/1994 | Constantine | |
| 5,293,700 | A | | 3/1994 | Ishii | |
| 5,297,957 | A | | 3/1994 | Brashears | |
| 5,306,481 | A | | 4/1994 | Mansour | |
| 5,325,604 | A | | 7/1994 | Little | |
| 5,345,695 | A | | 9/1994 | Graham | |
| 5,363,780 | A | | 11/1994 | Whitney | |
| 5,399,039 | A | | 3/1995 | Giles | |
| 5,406,316 | A | | 4/1995 | Schwiebert | |
| 5,406,321 | A | | 4/1995 | Schwiebert | |
| 5,413,746 | A | | 5/1995 | Birjukov | |
| 5,416,985 | A | | 5/1995 | Culp | |
| 5,425,182 | A | | 6/1995 | Brunner | |
| 5,454,426 | A | | 10/1995 | Moseley | |
| 5,461,408 | A | | 10/1995 | Giles | |
| 5,479,199 | A | | 12/1995 | Moore | |
| 5,500,667 | A | | 3/1996 | Schwiebert | |
| 5,534,437 | A | | 7/1996 | Arrau | |
| 5,536,488 | A | | 7/1996 | Mansour | |
| 5,557,858 | A | | 9/1996 | Macaluso | |
| 5,581,289 | A | | 12/1996 | Firl | |
| 5,595,000 | A | | 1/1997 | Goodwin | |
| 5,606,859 | A | | 3/1997 | Ploshkin | |
| 5,633,668 | A | | 5/1997 | Schwiebert | |
| 5,637,192 | A | | 6/1997 | Mansour | |
| 5,641,273 | A | | 6/1997 | Moseley | |
| 5,678,324 | A | | 10/1997 | Viitaniemi | |
| 5,685,153 | A | | 11/1997 | Dickinson | |
| 5,687,490 | A | | 11/1997 | Harrison | |
| 5,704,134 | A | | 1/1998 | Carter | |
| 5,758,434 | A | | 6/1998 | Gipson | |
| 5,770,267 | A | | 6/1998 | Bullock | |
| 5,784,805 | A | | 7/1998 | Hashimoto | |
| 5,788,865 | A | | 8/1998 | Smirnov | |
| 5,797,332 | A | | 8/1998 | Keller | |
| 5,815,945 | A | | 10/1998 | Ando | |
| 5,836,086 | A | | 11/1998 | Elder | |
| 5,851,246 | A | | 12/1998 | Bishop | |
| 5,851,309 | A | | 12/1998 | Kousa | |
| 5,852,880 | A | | 12/1998 | Harrison | |

5,873,182 A 2/1999 Fuller
5,878,509 A 3/1999 Burnett
5,899,004 A 5/1999 Sugaoka
5,901,463 A 5/1999 Guyonnet
5,915,811 A 6/1999 DeVore
5,926,968 A 7/1999 Gipson
5,940,984 A 8/1999 Moren
5,964,985 A 10/1999 Wootten
5,966,837 A 10/1999 Backa
5,970,624 A 10/1999 Moriya
5,979,074 A * 11/1999 Brunner et al. ..... 34/396
5,992,047 A 11/1999 Fuller
5,992,048 A 11/1999 DeVore
6,013,158 A 1/2000 Wootten
6,014,819 A 1/2000 Elder
6,024,226 A 2/2000 Olivier
RE36,728 E 6/2000 Ishii
6,105,278 A 8/2000 Gerrish
6,108,941 A 8/2000 Gillespy
6,110,316 A 8/2000 Kobayashi
6,112,677 A 9/2000 Kuntschar
6,119,364 A 9/2000 Elder
6,138,379 A * 10/2000 DeVore et al. ..... 34/395
6,141,888 A 11/2000 Cammarata
6,149,765 A 11/2000 Mansour
6,219,937 B1 4/2001 Culp
6,233,545 B1 5/2001 Datig
6,243,970 B1 6/2001 Culp
6,248,985 B1 6/2001 Tomasello
6,293,121 B1 9/2001 Labrador
6,327,994 B1 12/2001 Labrador
6,341,372 B1 1/2002 Datig
6,344,638 B1 2/2002 Tomasello
6,345,450 B1 * 2/2002 Elder ..... 34/396
6,348,679 B1 2/2002 Ryan
6,355,904 B1 3/2002 Batdorf
6,370,792 B1 * 4/2002 Culp et al. ..... 34/78
6,379,929 B1 4/2002 Burns
6,381,871 B2 5/2002 Uehara
6,393,723 B1 5/2002 Nagel
6,393,727 B1 5/2002 Seelig
6,467,190 B2 10/2002 Nagel
6,467,300 B1 10/2002 Noble, III
6,473,994 B1 11/2002 Dedieu
6,551,457 B2 4/2003 Westman
6,553,688 B1 4/2003 Lee
6,574,979 B2 6/2003 Faqih
6,600,142 B2 7/2003 Ryan
6,617,557 B1 9/2003 Ryan
6,640,462 B1 11/2003 Choi
6,649,888 B2 11/2003 Ryan
6,652,274 B2 11/2003 Nagel
6,667,429 B2 12/2003 Abe
6,675,495 B2 1/2004 Dedieu
6,680,456 B2 1/2004 Adams
6,684,648 B2 2/2004 Faqih
6,725,566 B1 4/2004 Skrotsky
6,729,043 B2 5/2004 Muhlbock
6,742,278 B2 6/2004 Vinden
6,742,283 B2 6/2004 Ishii
6,772,535 B2 8/2004 Koslow
6,796,476 B2 9/2004 Birk
6,817,556 B2 11/2004 Hesch
6,865,821 B2 3/2005 Merschat
6,868,690 B2 3/2005 Faqih
6,969,409 B2 11/2005 Ichimura
7,028,478 B2 4/2006 Prentice, III
7,043,853 B2 * 5/2006 Roberts et al. ..... 34/73
7,044,429 B1 5/2006 Foreman
7,089,685 B2 8/2006 Torgovnikov
7,135,332 B2 11/2006 Ouellette
7,146,747 B2 12/2006 Studd
7,169,489 B2 1/2007 Redmond
7,178,263 B2 2/2007 Asano
7,178,941 B2 2/2007 Roberge
7,220,365 B2 5/2007 Qu
7,226,675 B2 6/2007 Ovshinsky
7,241,322 B2 7/2007 Graham
7,246,452 B1 7/2007 Roy
7,248,942 B2 7/2007 Bash
7,281,561 B2 10/2007 Anderson
7,337,554 B2 3/2008 Erickson
7,370,434 B2 5/2008 Duncan
7,473,551 B2 1/2009 Warthoe
7,498,009 B2 3/2009 Leach
7,511,443 B2 3/2009 Townsend
7,523,603 B2 4/2009 Hagen
7,589,883 B2 9/2009 Varaprasad
7,612,735 B2 11/2009 Essig
7,624,801 B2 12/2009 Zubrin
7,637,030 B2 12/2009 Sugawara
7,638,070 B2 12/2009 Johnson
7,643,200 B2 1/2010 Varaprasad
7,650,939 B2 1/2010 Zubrin
7,676,953 B2 3/2010 Magill
7,683,126 B2 3/2010 Neal
7,685,819 B2 3/2010 Vetrovec
7,690,148 B2 4/2010 Hedman
7,694,688 B2 4/2010 Lester
7,700,027 B2 4/2010 Neal
7,703,301 B2 4/2010 Loibl
7,707,848 B2 5/2010 Loibl
7,732,039 B2 6/2010 Chakravarty
7,744,671 B1 6/2010 Ouellette
7,752,845 B2 7/2010 Johnson
7,761,954 B2 7/2010 Ziegler
7,792,711 B2 * 9/2010 Swafford et al. ..... 705/28
7,810,565 B2 10/2010 Zubrin
7,821,697 B2 10/2010 Varaprasad
7,841,282 B2 11/2010 Kimberlin
7,854,631 B2 12/2010 Townsendl
7,855,755 B2 12/2010 Weller
7,857,995 B2 12/2010 Johnson
7,893,644 B2 2/2011 Townsend
7,906,695 B2 3/2011 Giercke
2001/0001218 A1 5/2001 Luongo
2002/0002208 A1 1/2002 Martel
2002/0030721 A1 3/2002 Asakawa
2002/0108266 A1 8/2002 Nagel
2003/0029052 A1 2/2003 Nagel
2003/0066638 A1 4/2003 Qu
2003/0115771 A1 6/2003 Ishii
2003/0140751 A1 7/2003 McGehee
2003/0154622 A1 8/2003 Aaron
2003/0182819 A1 10/2003 Michon
2004/0168339 A1 * 9/2004 Roberts et al. ..... 34/218
2004/0171707 A1 9/2004 Martel
2005/0109603 A1 5/2005 Graham
2005/0120715 A1 6/2005 Labrador
2005/0220662 A1 10/2005 Hedman
2005/0223591 A1 10/2005 Huard
2005/0266200 A1 12/2005 Padmanabhan
2005/0283992 A1 12/2005 Kettler
2006/0080856 A1 4/2006 Erickson
2006/0101663 A1 5/2006 Perin
2006/0110499 A1 5/2006 Neto
2006/0112639 A1 6/2006 Nick
2006/0163272 A1 * 7/2006 Gamble ..... 221/227
2006/0168842 A1 8/2006 Sprague
2006/0191158 A1 8/2006 Duncan
2006/0196398 A1 9/2006 Graham
2006/0237381 A1 * 10/2006 Lockwood et al. ..... 211/59.3
2006/0272172 A1 * 12/2006 Pollard ..... 34/396
2006/0277784 A1 12/2006 Cheng
2006/0278336 A1 12/2006 Sundholm
2006/0280670 A1 12/2006 Teeter
2007/0000146 A1 1/2007 Boonstra
2007/0017113 A1 1/2007 Scharpf
2007/0033826 A1 2/2007 Seeger
2007/0044341 A1 * 3/2007 Pollard ..... 34/201
2007/0089805 A1 4/2007 Swaan
2007/0130788 A1 6/2007 Kunugi
2007/0173679 A1 7/2007 Guyomarc'h
2007/0187223 A1 8/2007 Graham
2008/0014111 A1 1/2008 Hedman
2008/0022548 A1 1/2008 Maynard
2008/0034681 A1 2/2008 McDonald
2008/0155985 A1 7/2008 Labrador

| | | | | |
|---|---|---|---|---|
| 2009/0013596 | A1 | 1/2009 | Wang | |
| 2009/0071062 | A1 | 3/2009 | Hedman | |
| 2009/0113752 | A1 * | 5/2009 | Weir | 34/282 |
| 2009/0266081 | A1 | 10/2009 | Graham | |
| 2010/0058607 | A1 | 3/2010 | Franich | |
| 2011/0056087 | A1 * | 3/2011 | Tinsley et al. | 34/201 |

FOREIGN PATENT DOCUMENTS

| | | | |
|---|---|---|---|
| CH | 677527 | A5 | 5/1991 |
| DE | 3120844 | A1 | 12/1982 |
| DE | 3715511 | A1 | 5/1986 |
| DE | 4209452 | A1 | 11/1991 |
| DE | 4202392 | A1 | 8/1993 |
| DE | 4312189 | A1 | 10/1994 |
| DE | 19951627 | A1 | 12/1998 |
| EP | 429947 | A1 | 11/1990 |
| EP | 430910 | A1 | 6/1991 |
| EP | 447376 | A1 | 9/1991 |
| EP | 634648 | A1 | 3/1994 |
| EP | 1132701 | A2 | 9/2001 |
| EP | 1439359 | A2 | 7/2004 |
| EP | 1975531 | A1 | 10/2008 |
| FR | 2564850 | A1 | 5/1984 |
| FR | 2572170 | A1 | 10/1985 |
| FR | 2581743 | A1 | 5/1986 |
| FR | 2631432 | A1 | 5/1988 |
| GB | 2147400 | A | 5/1985 |
| GB | 2183319 | A | 6/1987 |
| GB | 2183807 | A | 6/1987 |
| GB | 2190179 | A | 11/1987 |
| GB | 2273761 | A | 6/1994 |
| GB | 2455078 | A | 6/2009 |
| JP | 52028055 | A | 3/1977 |
| JP | 56027822 | A | 3/1981 |
| JP | 62130801 | A | 6/1987 |
| JP | 63039309 | A | 2/1988 |
| JP | 63070048 | A | 3/1988 |
| JP | 01139134 | A | 5/1989 |
| JP | 01310287 | A | 12/1989 |
| JP | 02098404 | A | 4/1990 |
| JP | 02140590 | A | 5/1990 |
| JP | 02192584 | A | 7/1990 |
| WO | 9006840 | A1 | 6/1990 |
| WO | 9217744 | A1 | 10/1992 |
| WO | 9415159 | A1 | 7/1994 |
| WO | 9601401 | A1 | 1/1996 |
| WO | 9601971 | A1 | 1/1996 |
| WO | 9611780 | A1 | 4/1996 |
| WO | 9700412 | A1 | 1/1997 |
| WO | 9729894 | A1 | 8/1997 |
| WO | 0159378 | A2 | 8/2001 |
| WO | 0178955 | A2 | 10/2001 |
| WO | 02065038 | A1 | 8/2002 |
| WO | 03106126 | A1 | 12/2003 |
| WO | 2004099692 | A1 | 11/2004 |
| WO | 2005052478 | A1 | 6/2005 |
| WO | 2007083863 | A1 | 7/2007 |
| WO | 2007083864 | A1 | 7/2007 |
| WO | 2007130058 | A1 | 11/2007 |

* cited by examiner

DUAL PATH KILN IMPROVEMENT

This is a Divisional Application of U.S. patent application Ser. No. 12/554,165, filed 4 Sep. 2009 now U.S. Pat. No. 8,201,501, the complete disclosure of which is incorporated herein by reference

FIELD OF THE INVENTION

The present invention relates to the field of lumber handling and more specifically, the present invention is directed to drying equipment for preparing raw lumber for sale. As is well known, fresh cut lumber includes a large quantity of moisture and it has been the practice to subject such lumber to heat treatment to drive off the moisture so that the lumber, as sold, will be less subject to warping or bending during storage or after installation in a structure.

BACKGROUND

As described in co-pending application U.S. patent application Ser. No. 11/525,929 filed Sep. 25, 2006, now U.S. Pat. No. 7,963,048, issued Jun. 21, 2011, and incorporated by reference herein, in this field, lumber drying was typically performed in a batch process where a quantity of raw moisture laden lumber is piled in one or more stacks and the stacks were moved into a kiln with an insulated chamber through which heated air was moved to effect removal of moisture from the lumber. As will be evident to those skilled in this technology, this was a labor-intensive and time-consuming process which greatly added to the expense of the finished lumber. One of the improvements of the aforementioned application resides in the use of two generally parallel paths for separate continuous drying lines which are moved in opposite directions through a plurality of chambers which are aligned along the separate paths and in communication with one another to increase the efficiency of the drying process. This is accomplished by continuously moving loads of lumber while conserving the heat that builds up in each load as it is continuously moved along one path in the kiln and transferring some of that heat from a load of dried lumber to an incoming load of green lumber moving from the opposite end of the kiln as they pass one another in the kiln. This results in a great economy in the utilization of the heat energy used in the heating zone which is generally centrally located along the two paths.

SUMMARY OF THE INVENTION

In the present invention, an improvement in the pusher mechanism, or load mover, for each load moved along the separate paths is provided where greater stability is assured for the lumber positioned on the carriages that are pushed on rails by separate pushing devices in which one is provided for each path. In particular, each pusher device is provided with a faceplate that engages the end of the load to be moved into the kiln with the faceplate extending over a significant area of the end of the load. Further, to allow increased speeds, the faceplate has extending arms to engage the sides of the end load to guard against any wobbling of the load such as may occur upon initiation of movement of the loads through the kiln chambers.

With this arrangement, increased speeds of transport of the loads along each path can be accomplished while minimizing the risks of accidental dislodgment of the load of stacked lumber from the carriage which could greatly diminish the efficiency of the drying process. To ensure stability, an improved pusher device is also provided with a smooth drive mechanism which will decrease the chances of spillage of the load of stacked lumber during the drying process.

BRIEF DESCRIPTION OF THE DRAWINGS

The operation and advantages of the present invention will become apparent as consideration is given to the following detailed description in conjunction with the accompanying drawings, in which.

DETAILED DESCRIPTION

Figure 1:
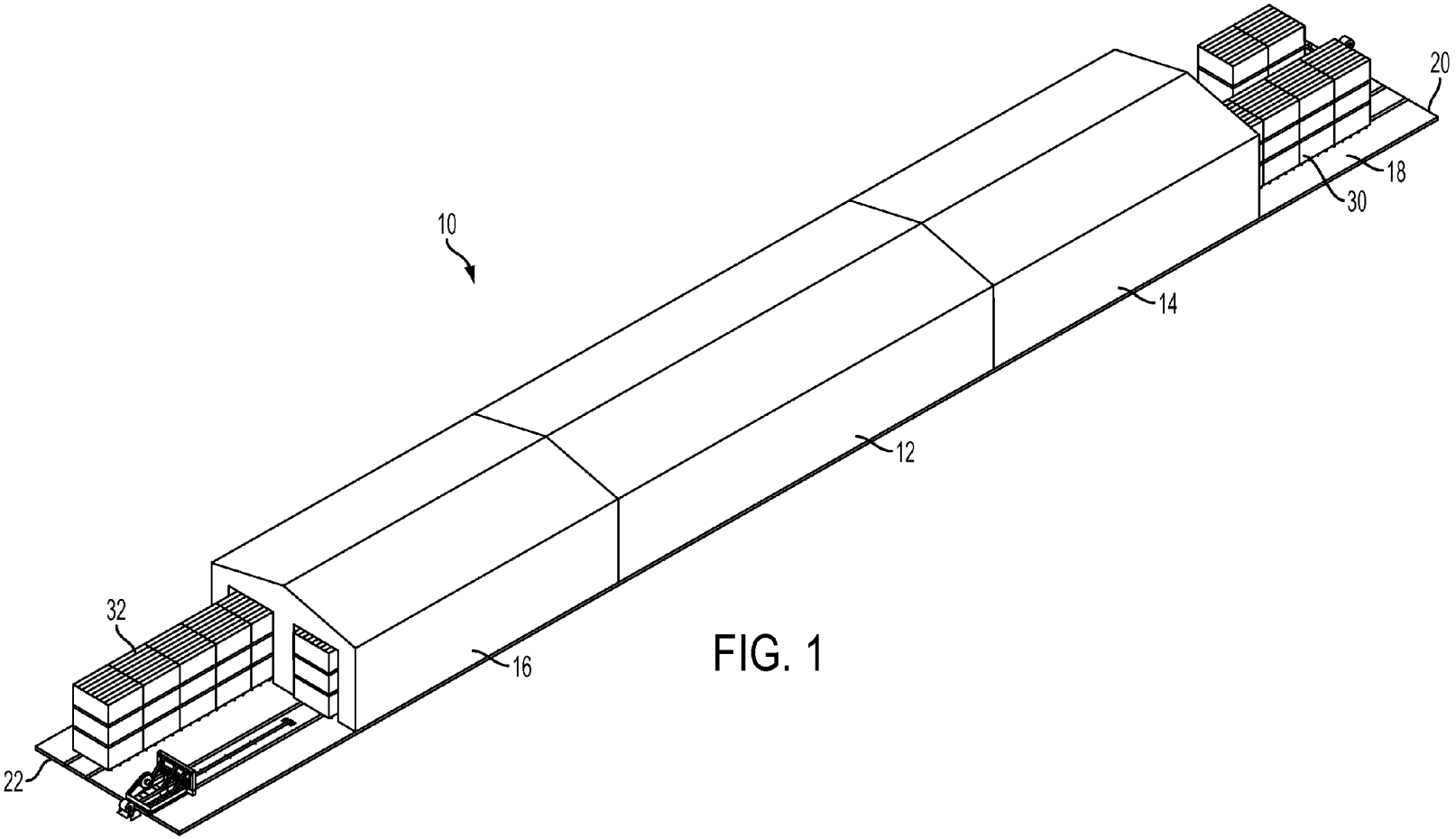
FIG. 1 is a perspective view of an improved continuous kiln arrangement.
Figure 2:
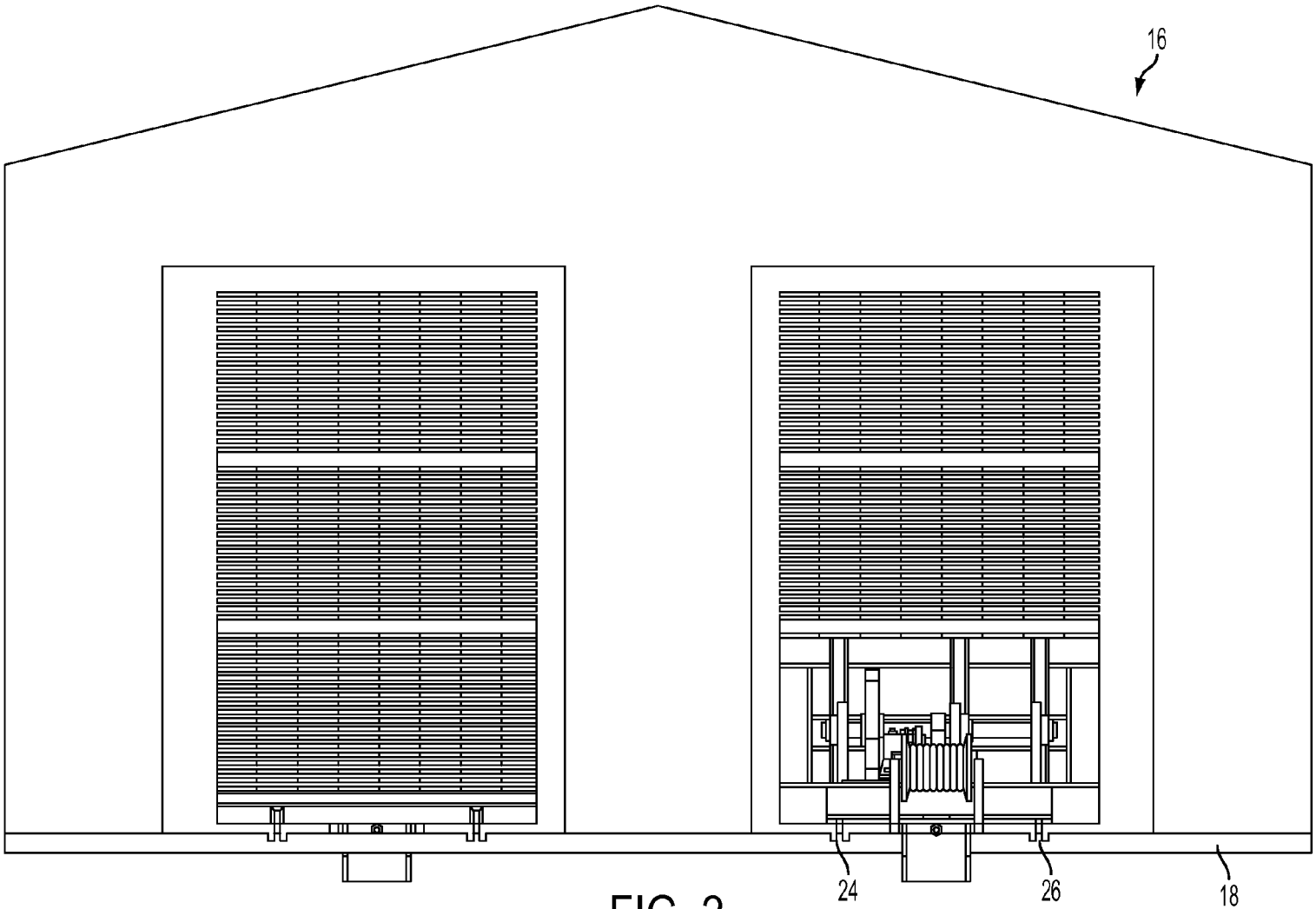
FIG. 2 is in end view in elevation of the continuous kiln arrangement of FIG. 1.
Figure 3:
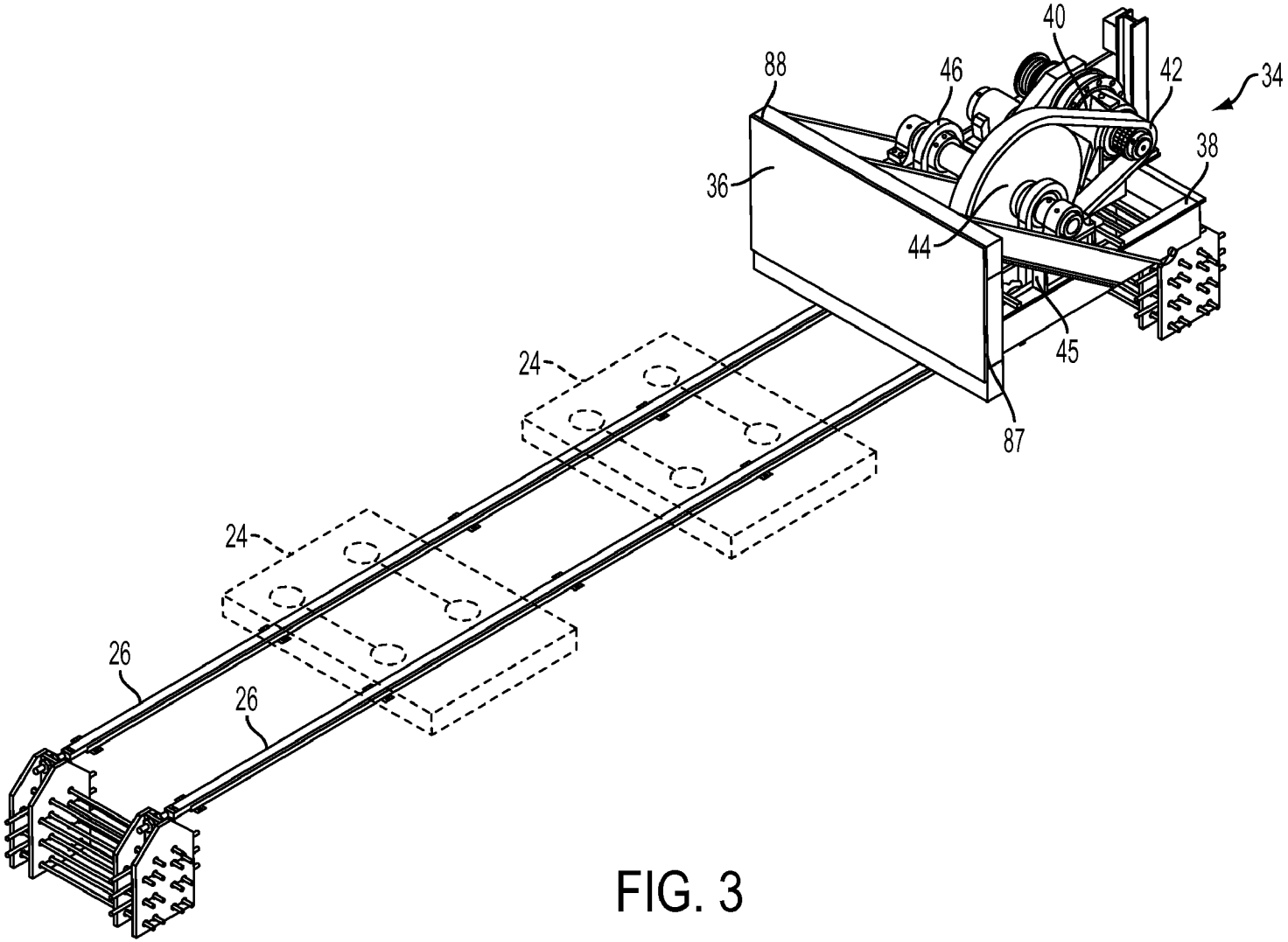
FIG. 3 is a perspective view of one form of the pusher device of the present invention.

Referring to the non-limiting Figures wherein like numerals designate corresponding parts throughout the various views, there is shown, in FIG. 1, a continuous kiln which typically will include a main heating chamber 12 and opposite end chambers 14 and 16 where heat transfer between the paths will take place aided typically by fans positioned to transfer heat between the passing loads of lumber as they are moved past one another. The base of the kiln 10 may be extended from an entry 22 located at opposite ends of the structure through the chambers 12, 14 and 16 and may include two pairs of parallel rails for each path. As shown in broken lines in FIG. 3, carriages 24 having wheels for engaging the rails 26 are provided and on which the loads of lumber 30, 32 are loaded at the opposite ends 20 and 22 of the base 18. In a typical arrangement, one end of a load of boards will be stacked on the forward carriage 24 while the rear end of the load of boards will rest on the trailing carriage 24 and in a large establishment, a plurality of carriages may be utilized to allow the operator of the kiln to fully occupy all three chambers of the kiln in a continuous drying operation. Alternatively, the pulley 44 transfers power to a single drive gear 74 that can be used to engage a track that is parallel with the rails 26. An example of the track is the chain 72. The drive gear 74 has teeth 76 which engage openings 78 in the links in the chain 72.

For small, and therefore relatively stable loads, a pusher device 34 will include a flat vertical plate 36 mounted in the front of a housing 38. The housing 38 is preferably an open frame and may be rectangular in shape and have one or more transverse support struts for supporting an electric motor 40 having an output connected through a belt or chain 42 to transmit rotary motion to a large wheel 44 which in turn rotates an axle rotatably mounted on supports one of which is shown at 45. This will transmit motion to the axle which in turn rotates pulleys one of which is shown at 46. With this arrangement, the pulleys 46 will transmit rotary motion to a pair of gears which will engage a link chain 72 mounted on the housing 38 between the rails 26. The pair of gears including a periphery from which teeth extend radially which are sized to each fit in openings in the links of the chain 72. Thus, with a variable output electric motor 40 mounted on the housing 38, a high degree of accurate control of the movement speed of the housing 38 and faceplate 36 can be obtained.

Figure 4:
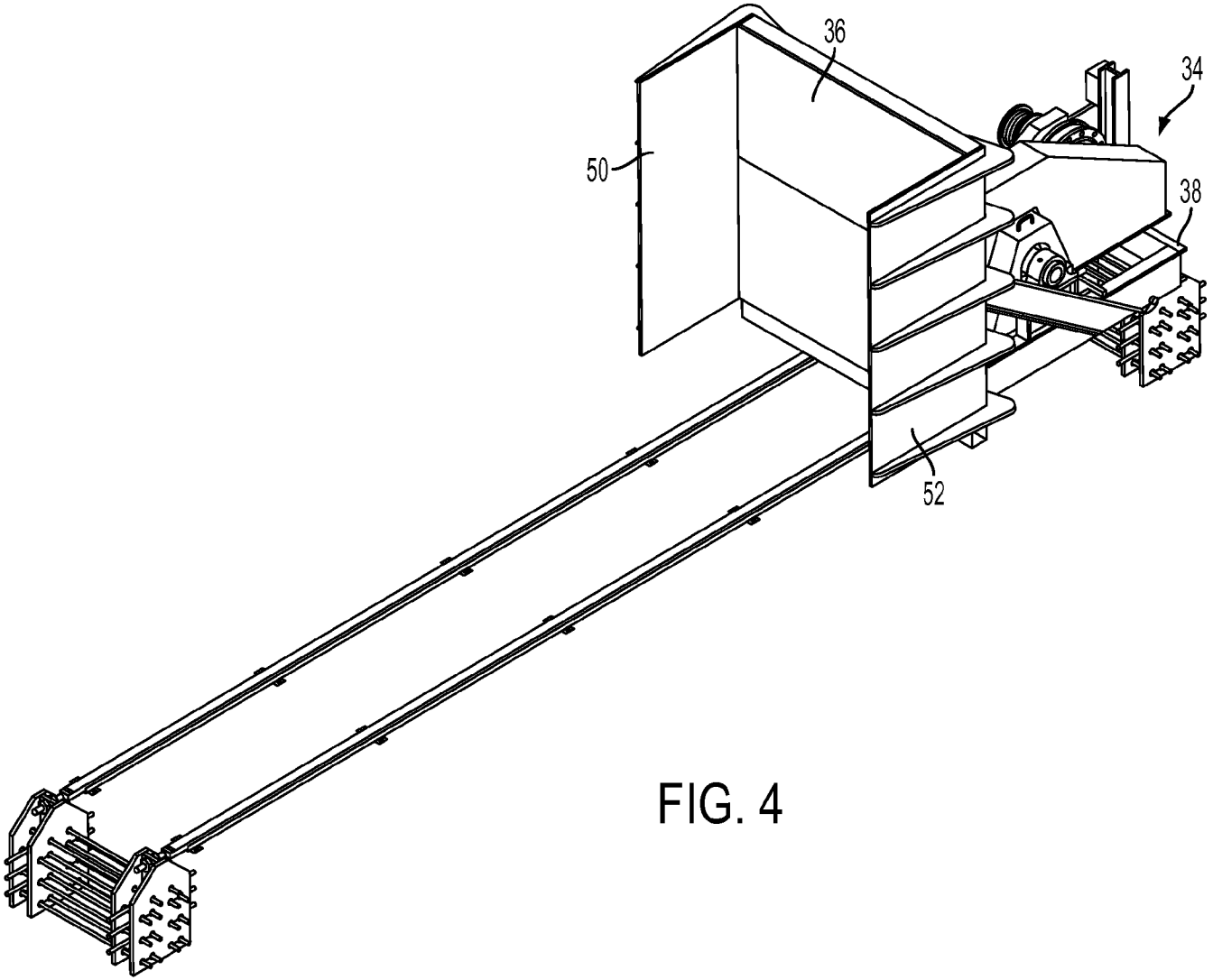
FIG. 4 is a perspective view of another embodiment of the pusher device of the present invention.

With larger loads and kiln structures having a greater capacity, more stability is needed in the transport of the loads of lumber to be kiln dried. According to the present invention this is achieved by the structure shown in FIG. 4 where the plate 36, having a first and a second end 88 and 87, is modified to include side plates 50 and 52 which extend horizontally from the plate's first and second ends 88 and 87 respectively such that said side plates 50 and 52 will engage a portion of the side of the loads carried on a carriage 24. The side plates may be of a vertical extent to engage substantially the full height of the load to be mounted on the carriages 24. The stability of the transportation function is therefore greatly enhanced and the risk of spillage of the load is minimized. It will be understood that the plates 50 and 52 may be perforated to allow free circulation of air at the end portions of the loads to assure even curing of the lumber in engagement with the plate 36 of the pusher device 34.

Figure 5:
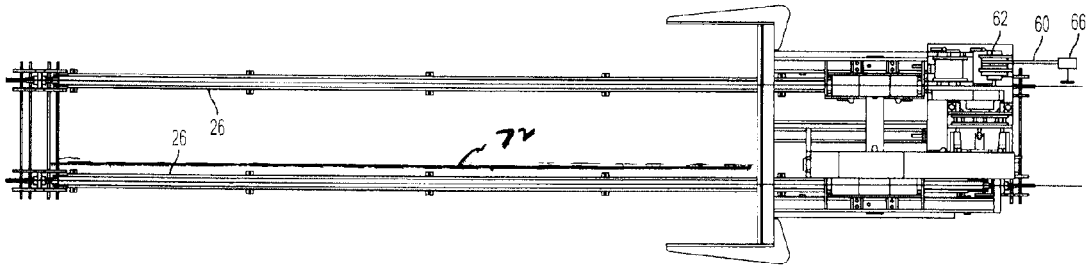
FIG. 5 a top plan view of the arrangement of FIG. 4.
Figure 6:
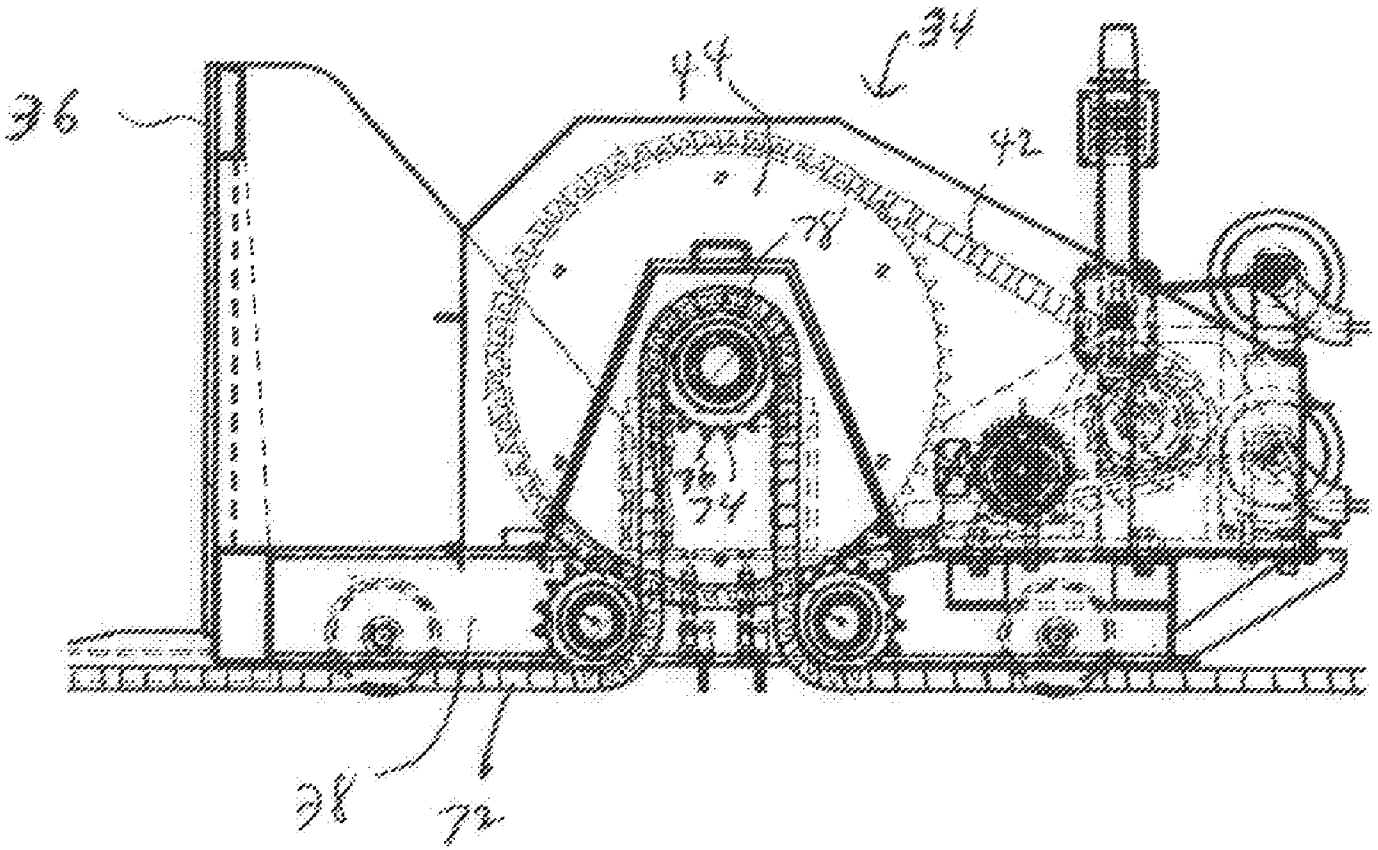
FIG. 6 is a side view of the pusher devise of the present invention.

As noted above, the use and of the electric motor 40 to effect movement of the housing 38 has the advantage that such motors can be of the variable speed type thus allowing close control of the speed of movement of the carriages and loads of lumber. Further, electrical power can be supplied through a cable 60 which is unwound from a spool 62 rotatably mounted on the top of the housing 38 as shown in FIG. 5. One end of the cable 60 is connected to the electric motor 40 and the opposite end of the cable 60 is connected to a current source 66 wherein a portion of the cable 60 is carried on the spool 62 which is resiliently urged to maintain tension on the cable. The rotation of the axle mounted pulleys 46 will be transmitted directly to drive gears which are rotatably mounted on the underside of the housing 38 and which preferably separately engage a sprocket chain at spaced apart positions where the sprocket chain is anchored to the base 18 and extends the full length of the paths of travel of the lumber to be dried.

While the claimed invention has been described in detail and with reference to specific embodiments thereof, it will be apparent to one of ordinary skill in the art that various changes and modifications can be made to the claimed invention without departing from the spirit and scope thereof.

We claim:

1. A method of drying lumber in a continuous kiln having at least three chambers arranged serially from one end of the kiln to the opposite end with the ends being open to allow the passage of a load mover and a load of lumber supported on a carriage, the kiln having a floor and a pair of parallel rails mounted on the floor and extending along a path that extends from outside the kiln through the chambers, the load mover including a housing having a wall with which at least a portion of the load is engageable during transport sequentially through the chambers of the kiln, the housing having wheels that, in use, engage and ride on the rails, the kiln having a track extending parallel to the rails and through the kiln, the track being mounted on the floor, the load mover having mounted thereon a variable speed electric motor and gearing constructed for transferring the output of the motor to a transport gear which is rotatably mounted on the housing of the load mover and which engages the track so that rotation of the transport gear will effect movement of the load mover on the rails, and the wall having a substantially vertical portion to engage the load supported on the carriage which rides on the rails where the vertical portion is positioned to be moved against the load to enhance the stability of the load during transport along the rails, the method comprising:

providing the load of lumber on the carriage; and using the electric motor to drive the transport gear engaging the track to move the load mover which pushes the load of lumber on the carriage through the kiln to produce dried lumber.

2. The method according to claim 1, wherein a front end of the load of lumber is supported by a forward carriage and a back end of the load of lumber is supported by a trailing carriage.

3. The method according to claim 1, further comprising a plurality of loads of lumber each being loaded on a respective carriage that fully occupies all three chambers of the kiln, with each successive load being against each other so that when the load mover pushes an end of a new load being moved into the kiln the new load pushes the previous loads through the kiln.

4. The method according to claim 1, wherein the track is a chain having links each of which provides an opening and the transport gear includes a periphery from which teeth extend radially and which are sized to each fit in the opening in the links of the chain.

5. The method according to claim 4, wherein the housing rotatably supports another transport gear spaced from the first mentioned transport gear with both of the spaced apart gears being driven by the motor and gearing.

6. The method according to claim 5, wherein the spaced apart gears both engage the chain at spaced apart positions.

7. The method according to claim 1, wherein the housing comprises a front side and a rear side with the motor being mounted adjacent the rear side and the load engaging portion of the wall being located adjacent the front side.

8. The method according to claim 7, further comprising supplying electricity to the electric motor using a flexible conduit having one end connectable to the motor and an opposite end connectable to a source of current, a portion of the conduit being carried on a spindle that is resiliently urged to maintain tension on the conduit.

9. A method of drying lumber in a continuous kiln having at least three chambers arranged serially from one end of the kiln to the opposite end with the ends being open to allow the passage of a load mover and a load of lumber supported on a carriage, the kiln having a floor and a pair of parallel rails mounted on the floor and extending along a path that extends from outside the kiln through the chambers, the load mover including a housing having a wall with which at least a portion of the load is engageable for transport sequentially through the chambers of the kiln, the housing having wheels that, in use, engage and ride on the rails, the kiln having a track extending parallel to the rails and through the kiln, the track being mounted on the floor, the load mover having mounted thereon a variable output electric motor and gearing constructed for transferring the output of the motor to a transport gear which is rotatably mounted on the housing of the load mover and which engages the track so that rotation of the transport gear will effect movement of the load mover on the rails, and the wall having a substantially vertical portion to engage the load supported on the carriage which rides on the rails where the vertical portion is positioned to be moved against the load to enhance the stability of the load during transport along the rails, the wall having a first end and a second end wherein a first and a second sidewall each extends horizontally from the wall's first and second ends respectively, the method comprising:

providing the load of lumber on the carriage; and using the electric motor to drive the transport gear engaging the track to move the load mover which pushes the load of lumber on the carriage through the kiln to produce dried lumber.

10. The method according to claim 9, wherein a front end of the load of lumber is supported by a forward carriage and a back end of the load of lumber is supported by a trailing carriage.

11. The method according to claim 9, further comprising a plurality of loads of lumber each being loaded on a respective carriage that fully occupies all three chambers of the kiln, with each successive load being against each other so that when the load mover pushes an end of a new load being moved into the kiln the new load pushes the previous loads through the kiln.

12. The method according to claim 9, wherein the first and second sidewalls are perforated to allow free circulation of air and even curing of the load.

13. The method according to claim 12, wherein the first and second sidewalls are configured to engage the full height of the load.

* * * * *